US006571857B2

(12) United States Patent
Darolia et al.

(10) Patent No.: US 6,571,857 B2
(45) Date of Patent: Jun. 3, 2003

(54) PROCESSING OF NICKEL ALUMINIDE MATERIAL

(75) Inventors: Ramgopal Darolia, West Chester, OH (US); Joseph David Rigney, Milford, OH (US)

(73) Assignee: General Electric Company, Schenectady, NY (US)

( * ) Notice: Subject to any disclaimer, the term of this patent is extended or adjusted under 35 U.S.C. 154(b) by 37 days.

(21) Appl. No.: 10/037,127

(22) Filed: Nov. 7, 2001

(65) Prior Publication Data

US 2003/0085020 A1 May 8, 2003

(51) Int. Cl.[7] ..... B22D 27/00; C22C 1/02; C22F 1/10

(52) U.S. Cl. ..... 164/57.1; 420/590; 148/556

(58) Field of Search ..... 164/55.1, 57.1; 420/590, 460; 75/628, 959; 148/556, 676, 677

(56) References Cited

U.S. PATENT DOCUMENTS 4,762,558 A * 8/1988 German et al. ..... 75/246
4,990,199 A * 2/1991 Nazmy et al. ..... 148/429
5,824,166 A * 10/1998 McDonald ..... 148/428
5,975,852 A 11/1999 Nagaraj et al. ..... 416/241 R
6,153,313 A 11/2000 Rigney et al. ..... 428/632
6,255,001 B1 7/2001 Darolia ..... 428/610
6,291,084 B1 9/2001 Darolia et al. ..... 428/633

FOREIGN PATENT DOCUMENTS

JP 6-142894 * 5/1994 ..... B22D/21/00

* cited by examiner

*Primary Examiner*—M. Alexandra Elve
*Assistant Examiner*—Kevin P. Kerns
(74) *Attorney, Agent, or Firm*—David L. Narciso; Gary M. Hartman; Domenica N. S. Hartman

(57) ABSTRACT

A process for casting and preparing an ingot of a beta-phase NiAl-based material, particularly for use in PVD coating processes. The method entails melting a nickel-aluminum composition having an aluminum content below that required for stoichiometric beta-phase NiAl intermetallic so as to form a melt that includes nickel and $Ni_3Al$. Aluminum is then added to the melt, causing an exothermic reaction between nickel and aluminum as the melt equilibrium shifts from $Ni_3Al$ to NiAl. However, the aluminum is added at a rate sufficiently low to avoid a violent exothermic reaction. The addition of aluminum continues until sufficient aluminum has been added to the melt to yield a beta-phase NiAl-based material. The beta-phase NiAl-based material is then solidified to form an ingot, which is then heated and pressed to close porosity and homogenize the microstructure of the ingot.

24 Claims, 1 Drawing Sheet

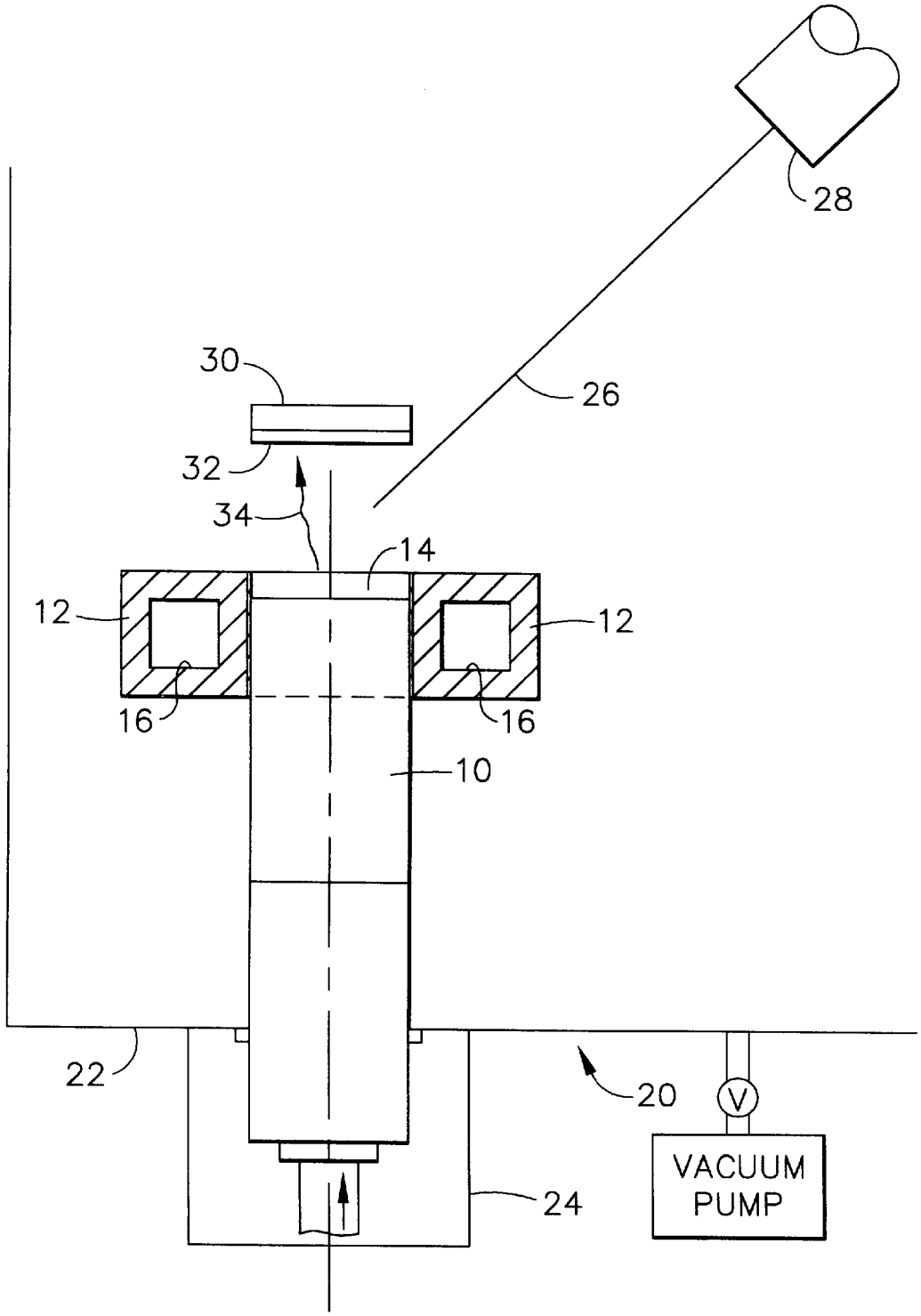
28
26
30
32
34
14
12
12
16
16
10
22
20
V
VACUUM
PUMP
24

PROCESSING OF NICKEL ALUMINIDE MATERIAL

CROSS REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The present invention generally relates to the processing of nickel aluminide intermetallic materials. More particularly, this invention relates to a process for producing a beta-phase nickel aluminide-based ingot, such as for use as a source material in physical vapor deposition (PVD) processes.

2. Description of the Related Art

Components within the turbine, combustor and augmentor sections of gas turbine engines are susceptible to oxidation and hot corrosion attack, in addition to high temperatures that can decrease their mechanical properties. Consequently, these components are often protected by an environmental coating alone or in combination with an outer thermal barrier coating (TBC), which in the latter case is termed a TBC system.

Diffusion coatings, such as diffusion aluminides and particularly platinum aluminides (PtAl), and overlay coatings, particularly MCrAlX alloys (where M is iron, cobalt and/or nickel, and X is an active element such as yttrium or another rare earth or reactive element), are widely used as environmental coatings for gas turbine engine components. Ceramic materials such as zirconia ($ZrO_2$) partially or fully stabilized by yttria ($Y_2O_3$), magnesia (MgO) or other oxides, are widely used as TBC materials. Used in combination with TBC, diffusion aluminide and MCrAlX overlay coatings serve as a bond coat to adhere the TBC to the underlying substrate. The aluminum content of these bond coat materials provides for the slow growth of a strong adherent continuous aluminum oxide layer (alumina scale) at elevated temperatures. This thermally grown oxide (TGO) protects the bond coat from oxidation and hot corrosion, and chemically bonds the TBC to the bond coat.

More recently, overlay coatings (i.e., not a diffusion) of beta-phase nickel aluminide (βNiAl) intermetallic have been proposed as environmental and bond coat materials. The NiAl beta phase exists for nickel-aluminum compositions of about 30 to about 60 atomic percent aluminum, the balance of the nickel-aluminum composition being nickel. Notable examples of beta-phase NiAl coating materials include commonly-assigned U.S. Pat. No. 5,975,852 to Nagaraj et al., which discloses a NiAl overlay bond coat optionally containing one or more active elements, such as yttrium, cerium, zirconium or hafnium, and commonly-assigned U.S. Pat. No. 6,291,084 to Darolia et al., which discloses a NiAl overlay coating material containing chromium and zirconium. Commonly-assigned U.S. Pat. Nos. 6,153,313 and 6,255,001 to Rigney et al. and Darolia, respectively, also disclose beta-phase NiAl bond coat and environmental coating materials. The beta-phase NiAl alloy disclosed by Rigney et al. contains chromium, hafnium and/or titanium, and optionally tantalum, silicon, gallium, zirconium, calcium, iron and/or yttrium, while Darolia's beta-phase NiAl alloy contains zirconium. The beta-phase NiAl alloys of Nagaraj, Darolia et al., Rigney et al., and Darolia have been shown to improve the adhesion of a ceramic TBC layer, thereby increasing the service life of the TBC system.

Suitable processes for depositing a beta-phase NiAl coating are thermal spraying and physical vapor deposition processes, the latter of which includes electron beam physical vapor deposition (EBPVD), magnetron sputtering, cathodic arc, ion plasma, and combinations thereof. PVD processes require the presence of a coating source material made essentially of the coating composition desired, and means for creating a vapor of the coating source material in the presence of a substrate that will accept the coating. FIG. 1 schematically represents a portion of an EBPVD coating apparatus 20, including a coating chamber 22 in which a component 30 is suspended for coating. A beta-phase NiAl overlay coating 32 is represented as being deposited on the component 30 by melting and vaporizing an ingot 10 of the beta-phase NiAl with an electron beam 26 produced by an electron beam gun 28. The intensity of the beam 26 is sufficient to produce a stream of vapor 34 that condenses on the component 30 to form the overlay coating 32. As shown, the vapor 34 evaporates from a pool 14 of molten beta-phase NiAl contained within a reservoir formed by crucible 12 that surrounds the upper end of the ingot 10. Water or another suitable cooling medium flows through cooling passages 16 defined within the crucible 12 to maintain the crucible 12 at an acceptable temperature. As it is gradually consumed by the deposition process, the ingot 10 is incrementally fed into the chamber 22 through an airlock 24.

The preparation of beta-phase NiAl for deposition by PVD typically requires the use of a vacuum induction melting (VIM) furnace in order to promote the purity of the composition by reducing the levels of residual elements such as oxygen. Other typical requirements for the ingot 10 include full density (e.g., pore-free), chemical homogeneity, mechanical integrity (e.g., crack-free), and dimensions and dimensional tolerances suitable for the particular PVD machine used. However, the casting and finish machining of beta-phase NiAl-based compositions are difficult to control as a result of the high melting point (1640° C.), very low room temperature ductility and low ambient fracture toughness (about 6 $MPa \cdot m^{1/2}$) of NiAl. The brittle nature of beta-phase NiAl-based materials particularly complicates the preparation of large ingots (e.g., diameters of about 2.5 inches (about 6.35 mm), lengths of about 20 to 30 inches (about 50.8 to 78.2 cm)) suitable for EBPVD processes, and machinable stock material required for cathodic arc processes. Also of concern is an exothermic reaction that takes place between nickel and aluminum when beta-phase NiAl is melted. When processing beta-phase NiAl in very small amounts, this exothermic reaction does not typically pose a significant problem. However, in the production of ingots of sufficient size for use in EBPVD processes, the exothermic reaction can be catastrophic to the processing equipment and therefore hazardous to personnel.

In view of the above, what is needed is a process for preparing, casting and processing an ingot of a beta-phase NiAl-based material that would be suitable for use in PVD coating processes, and particularly for creating relatively large cylindrical ingots for EBPVD processes and machinable stock material for cathodic arc and sputtering processes.

BRIEF SUMMARY OF THE INVENTION

The present invention is a process for preparing, casting and processing a beta-phase NiAl-based material, particularly for use in PVD coating processes. Materials produced by the process of this invention are preferably in the form of ingots that are crack-free, full density, chemically homogeneous, and capable of being machined to dimensional tolerances suitable for use in a PVD machine. In addition, the process is carried out so as to avoid the violent exothermic reaction between nickel and aluminum when beta-phase NiAl is melted.

The method entails melting a nickel-aluminum composition having an aluminum content below that required for stoichiometric beta-phase NiAl intermetallic so as to form a melt comprising nickel and $Ni_3Al$. Aluminum is then added to the melt, causing an exothermic reaction between nickel and aluminum as the melt equilibrium shifts from $Ni_3Al$ to NiAl. However, the aluminum is added at a sufficiently low rate to avoid a violent exothermic reaction. The addition of aluminum continues until sufficient aluminum has been added to the melt to yield a beta-phase NiAl-based material, i.e., containing the NiAl beta-phase. The beta-phase NiAl-based material is then solidified to form an ingot, which is heated and pressed to close porosity and homogenize the microstructure of the ingot.

The process of this invention is capable of producing ingots of a variety of beta-phase NiAl intermetallic materials, including those that contain chromium, zirconium and/or hafnium. Importantly, the process enables the production of relatively large ingots for use in EBPVD processes and machinable stock material for use in cathodic arc and sputtering processes, while avoiding the risk of the potentially catastrophic effect of the exothermic reaction that occurs when beta-phase NiAl is melted. As a result, ingots produced by this invention are particularly well suited for use in physical vapor deposition processes used to deposit beta-phase NiAl coatings, such as overlay environmental coatings and bond coats used in TBC systems to protect components from thermally hostile environments, including components of the turbine, combustor and augmentor sections of a gas turbine engine.

Other objects and advantages of this invention will be better appreciated from the following detailed description.

BRIEF DESCRIPTION OF THE DRAWINGS

FIG. 1 shows a schematic representation of a portion of an electron beam physical vapor deposition apparatus used to evaporate a beta-phase NiAl-based intermetallic material produced by the process of this invention.

DETAILED DESCRIPTION OF THE INVENTION

The EBPVD coating apparatus 20 depicted in FIG. 1 and discussed above is representative of the type of PVD apparatus that can utilize NiAl-based ingots 10 produced with the process of the present invention. Notable examples of beta-phase NiAl-based intermetallic materials disclosed in the previously-noted U.S. Pat. Nos. 5,975,852 to Nagaraj et al., 6,153,313 to Rigney et al., 6,255,001 to Darolia, and 6,291,084 to Darolia et al., which contain one or more of chromium, hafnium, titanium, tantalum, silicon, gallium, zirconium, calcium, iron, cerium and/or yttrium. It is believed that the process of this invention is also suitable for producing other beta-phase NiAl materials.

As discussed above, the NiAl alloys disclosed by Nagaraj et al., Rigney et al., Darolia and Darolia et al. are formulated as environmental coatings and bond coats for gas turbine engine applications, represented by the component 30 shown in FIG. 1. Intense heating of the NiAl ingot 10 by the electron beam 26 causes molecules of the NiAl material to evaporate, travel upwardly, and then deposit (condense) on the surface of the component 30, all in a manner known in the art. For deposition by a PVD process, the beta-phase NiAl ingot 10 preferably is at full density (e.g., pore-free) and chemically homogeneous to reduce spitting, which is an ejection of a particle from the molten pool that causes undesirable macroparticles to be incorporated into the coating 32. In addition, the ingot 10 preferably has sufficient mechanical integrity to be machinable for obtaining the dimensions and dimensional tolerances required for the particular PVD machine. These and other challenges are compounded by the concern for the violent exothermic reaction that takes place between nickel and aluminum when beta-phase NiAl is melted.

The above concerns and challenges are overcome by a process that entails initially melting a composition of nickel and aluminum, in which the aluminum content is below that necessary to form beta-phase NiAl intermetallic (i.e., below about 31 atomic percent aluminum relative to the nickel content). In a preferred embodiment, an initial charge of nickel and aluminum (and potentially other alloying ingredients) containing less than the peritectic 25.5 atomic percent aluminum, such as about 20 atomic percent aluminum (relative to the nickel content of the charge), is melted in a vacuum induction melting (VIM) furnace by increasing power to the furnace until the charge is melted. Prior to introducing the initial charge, revert (previously reacted beta-NiAl, $Ni_3Al$, with or without other alloying constituents), typically in an amount less than 50 wt. % of the total melt, may be melted in the crucible to reduce or buffer the exothermic reaction. At about 20 atomic percent aluminum, the melt is a mixture of nickel and the intermetallic phase $Ni_3Al$ (nominally 75 and 25 atomic percent nickel and aluminum, respectively), the latter having a eutectic melting point of about 1385° C. To raise the aluminum content sufficiently to obtain beta-phase NiAl (having stoichiometric aluminum content of 50 atomic percent), elemental aluminum is slowly added to the melt. When aluminum is added in an amount at and above the peritectic point (25.5 atomic percent aluminum), an equilibrium is established between NiAl (solid), liquid metal (nickel) and $Ni_3Al$ (solid). The addition of aluminum causes a shift in the equilibrium toward NiAl, associated with a tremendous release of energy (the exotherm) in the reaction of the molten metal and $Ni_3Al$ to form NiAl. As a result of this energy release, power to the VIM furnace can be reduced. Subsequent slow additions of aluminum and adjustments in power to the VIM furnace are then needed to take the melt composition toward the targeted beta-phase NiAl composition, at which point essentially all of the nickel and aluminum of the original nickel-aluminum composition and essentially all of the added aluminum has exothermically reacted to form beta-phase NiAl. Throughout the process of adding aluminum, the melt within the VIM furnace is continuously stirred as a result of induction melting and the exothermic reaction, ensuring a homogeneous melt.

In view of the above, the melting process of this invention can utilize a relative low amount of energy to create a melt of NiAl because the initial melt is molten at a temperature less than the melting temperature of NiAl (about 1640° C.), and subsequent temperature increases can be achieved without little or no increase in power to the furnace by careful additions of aluminum to control the exothermic reaction. This benefit is in addition to the basic need to control the violent exothermic reaction between nickel and aluminum that might otherwise cause operator injury and equipment damage (e.g., excessive liner deterioration, spills, etc.).

Following the melt process, additional steps may be required to produce a fully dense, crack-free ingot of beta-phase NiAl-based material. In the process of pouring the melt into a suitable crucible for solidification, a hot top or riser is preferably used by which additional melt is available to fill the porosity as it develops in the solidifying ingot. The solidification (casting) process can be carried out using known techniques to produce polycrystalline, directionally-solidified or single-crystal ingots of NiAl. The resulting ingot undergoes hot isostatic pressing (HIPping) to further close porosity and other defects, and to homogenize the microstructure of the ingot. Prior to a high temperature heat treatment, HIPping may also be necessary to improve the evaporative qualities of the ingot, and/or to put into solution any secondary phases that are present in addition to the NiAl beta-phase as a result of the particular NiAl-based composition. For example, if the NiAl-based composition is alloyed to contain titanium, zirconium and/or hafnium, beta prime (β') Heusler phases ($Ni_2AlX$ where X may be Ti, Hf. Zr, Ta, Nb and/or V) will be present, namely $Ni_2AlZr$ and/or $Ni_2AlHf$. Other Heusler phases are possible, depending on the composition of the melt. If chromium is present in the melt (e.g., the desired composition is NiAl+CrZr), alpha chromium (α-Cr) secondary phases may also be present. If these additional phases are not solutionized, the ingot will likely be very brittle, with the result that subsequent machining (e.g., centerless grinding to obtain a uniform diameter) may cause extensive cracking. In order to put these phases in solution without melting them, it is believed that very slow temperature increases must be performed prior to the HIPping process.

The following heat treatment schedule is devised for the dissolution of secondary phases prior to performing the HIPping operation. As noted above, those heat treatment steps (steps 1–6) performed before HIPping can be omitted, as can the fast cooling rate of step 8, if the NiAl-based composition does not contain titanium, zirconium, hafnium or other elements that would produce secondary phases requiring dissolution.

(1) Heat treatment at a temperature of about 2300° F. (about 1260° C.) for a duration of about twelve hours.

(2) Heat at a rate of about 200° F./hour (about 10° C./hour) to about 2375° F. (about 1300° C.) and hold for a duration of about twenty-four hours.

(3) Heat at a rate of about 200° F./hour (about 10° C./hour) to about 2425° F. (about 1330° C.) and hold for a duration of about twenty-four hours.

(4) Heat at a rate of about 200° F./hour (about 100° C./hour) to about 2500° F. (about 1370° C.) and hold for a duration of about thirty-two hours.

(5) Cool at a rate of about 100 to about 150° F./minute (about 55 to about 850° C./minute) to a temperature of less than 1800° F. (about 980° C.).

(6) Cool at any suitable rate to room temperature (about 25° C.).

(7) After heating at any suitable rate, HIP at about 2200° F. (about 1200° C.) up to near the melting temperature for a duration of about six hours at a pressure of about 15 to 30 ksi (about 100 to 200 MPa), preferably about 20 ksi (about 140 MPa);

(8) Cool at a rate of about 100 to about 150° F. minute (about 55 to about 85° C./minute) to less than 1800° F. (about 980° C.).

(9) Cool at any suitable rate to room temperature (about 25° C.).

All of the above steps are performed in an inert atmosphere, such as argon.

Following HIPping, the ingot may be machined to a final desired dimension, such as by centerless grinding (for a cylindrical bar), with the removal rate being adjusted to induce low stresses as known in the art. Alternative machining techniques include electrochemical machining (ECM) and electro-discharge machining (EDM) under low power and adequate coolant flow. If required to produce a better surface finish, the ingot can be chemically polished in a solution of about 15 volume percent $HNO_3$ and about 85 volume percent $H_3PO_4$ for about five to thirty minutes at a temperature of about 125 to 150° F. (about 50 to about 65° C.).

In practice, the above processing steps have been shown to enable the production of NiAl-based ingots of a size and quality suitable for use in EBPVD processes to form overlay coatings. Additional benefits include the use of lower initial melt temperatures, lower power input levels to the melt furnace, and improved lives for the melting furnace liner and crucibles by avoiding excessive heating during the exothermic reaction when NiAl is melted.

While the invention has been described in terms of a preferred embodiment, it is apparent that modifications could be adopted by one skilled in the art. Accordingly, the scope of the invention is to be limited only by the following claims.

What is claimed is:

1. A process for producing an ingot of a beta-phase NiAl-based material, the process comprising the steps of:

melting a nickel-aluminum composition having an aluminum content below that required for stoichiometric beta-phase NiAl intermetallic so as to form a melt comprising nickel and $Ni_3Al$;

adding aluminum to the melt to cause an exothermic reaction between nickel and aluminum as the melt equilibrium shifts from $Ni_3Al$ to NiAl, but at a rate sufficiently low to avoid a violent exothermic reaction, sufficient aluminum being added to the melt to yield a beta-phase NiAl-based material;

solidifying the beta-phase NiAl-based material to form an ingot; and then heating and pressing the ingot to close porosity and homogenize the microstructure of the ingot.

2. A process according to claim 1, wherein the aluminum content of the nickel-aluminum composition is not greater than 25.5 atomic percent.

3. A process according to claim 1, wherein the aluminum content of the nickel-aluminum composition is about 20 atomic percent.

4. A process according to claim 1, wherein essentially all of the nickel and aluminum of the nickel-aluminum composition and essentially all of the added aluminum exothermically reacts to form beta-phase NiAl.

5. A process according to claim 1, wherein the beta-phase NiAl-based material further contains at least one of chromium, zirconium, and hafnium.

6. A process according to claim 1, wherein the beta-phase NiAl-based material consists essentially of nickel, aluminum, chromium and zirconium or hafnium.

7. A process according to claim 1, wherein the heating and pressing step comprises heat-treating the ingot at temperatures and for durations sufficient to dissolve without melting secondary phases present in the beta-phase NiAl-based material in addition to beta-phase NiAl.

8. A process according to claim 7, wherein the secondary phases include one or more of Heusler phases and alpha chromium phases.

9. A process according to claim 1, wherein the heating and pressing step comprises hot isostatic pressing the ingot at a temperature of about 1200° C. or more.

10. A process according to claim 1, wherein the heating and pressing step comprises the steps of:

heat-treating the ingot at a temperature of about 1260° C. for a duration of about twelve hours;

heating the ingot at a rate of about 10° C./hour to a temperature of about 1300° C. that is held for a duration of about twenty-four hours;

heating the ingot at a rate of about 10° C./hour to a temperature of about 1330° C. that is held for a duration of about twenty-four hours;

heating the ingot at a rate of about 10° C./hour to a temperature of about 1370° C. that is held for a duration of about thirty-two hours;

cooling the ingot at a rate of about 55 to about 85° C./minute to a temperature of less than 980° C.;

cooling the ingot to about 25° C.;

hot isostatic pressing the ingot at a temperature of about 1200° C. or more for a duration of about six hours at a pressure of about 100 to about 200 MPa;

cooling the ingot at a rate of about 55 to about 85° C./minute to a temperature of less than 980° C.; and then cooling the ingot to about 25° C.

11. A process according to claim 1, wherein prior to the melting step, revert comprising at least one of beta-NiAl and $Ni_3Al$ is added to a container in which the melting step is performed, the revert is melted, and then the nickel-aluminum composition is added to the container.

12. A process according to claim 1, further comprising the step of machining the ingot after the heating and pressing step.

13. A process according to claim 1, further comprising the step of evaporating the ingot after the heating and pressing step to deposit a coating of the beta-phase NiAl-based material.

14. A process for producing an ingot of a beta-phase NiAl-based material, the process comprising the steps of:

melting a nickel-aluminum composition having an aluminum content below 25.5 atomic percent so as to form a melt comprising nickel and $Ni_3Al$;

while stirring the melt, adding aluminum to the melt to cause an exothermic reaction between nickel and aluminum as the melt equilibrium shifts from $Ni_3Al$ to NiAl, but at a rate sufficiently low to avoid a violent exothermic reaction, sufficient aluminum being added to the melt to yield a molten beta-phase NiAl-based material in which aluminum is present in an amount relative to nickel of about 30 to 60 atomic percent;

solidifying the molten beta-phase NiAl-based material to form an ingot of beta-phase NiAl-based material;

heating and pressing the ingot to close porosity and homogenize the microstructure of the ingot, the ingot being heated at temperatures and for durations sufficient to dissolve without melting secondary phases present in the beta-phase NiAl-based material in addition to beta-phase NiAl;

machining the ingot; and then evaporating the ingot to deposit a coating of the beta-phase NiAl-based material.

15. A process according to claim 14, wherein the aluminum content of the nickel-aluminum composition is about 20 atomic percent.

16. A process according to claim 14, wherein essentially all of the nickel and aluminum of the nickel-aluminum composition and essentially all of the added aluminum exothermically reacts to form beta-phase NiAl.

17. A process according to claim 14, wherein the beta-phase NiAl-based material further contains at least one of chromium, zirconium and hafnium.

18. A process according to claim 17, wherein the secondary phases include one or more of $Ni_2AlZr$, $Ni_2AlHf$, and alpha chromium.

19. A process according to claim 14, wherein the beta-phase NiAl-based material consists essentially of nickel, aluminum, chromium and zirconium or hafnium.

20. A process according to claim 19, wherein the secondary phases include one or more of $Ni_2AlZr$, $Ni_2AlHf$, and alpha chromium.

21. A process according to claim 14, wherein the heating and pressing step comprises hot isostatic pressing the ingot at a temperature of about 1200° C. or more.

22. A process according to claim 14, wherein the heating and pressing step comprises the steps of:

heat-treating the ingot at a temperature of about 1260° C. for a duration of about twelve hours;

heating the ingot at a rate of about 10° C./hour to a temperature of about 1300° C. that is held for a duration of about twenty-four hours;

heating the ingot at a rate of about 10° C./hour to a temperature of about 1330° C. that is held for a duration of about twenty-four hours;

heating the ingot at a rate of about 10° C./hour to a temperature of about 1370° C. that is held for a duration of about thirty-two hours;

cooling the ingot at a rate of about 55 to about 85° C./minute to a temperature of less than 980° C.;

cooling the ingot to about 25° C.;

hot isostatic pressing the ingot at a temperature of about 1200° C. or more for a duration of about six hours at a pressure of about 100 to about 200 MPa;

cooling the ingot at a rate of about 55 to about 85° C./minute to a temperature of less than 980° C.; and then cooling the ingot to about 25° C.

23. A process according to claim 14, wherein the evaporating step is performed with an electron beam physical vapor deposition apparatus, a cathodic arc deposition apparatus, or a sputtering apparatus.

24. A process according to claim 14, wherein prior to the melting step, revert comprising at least one of beta-NiAl and $Ni_3Al$ is added to a container in which the melting step is performed, the revert is melted, and then the nickel-aluminum composition is added to the container.

* * * * *